US005439563A

United States Patent [19]

Sivilotti

[11] Patent Number: 5,439,563

[45] Date of Patent: Aug. 8, 1995

[54] ELECTROLYTIC PRODUCTION OF MAGNESIUM METAL WITH FEED CONTAINING MAGNESIUM CHLORIDE AMMONIATES

[75] Inventor: Olivo G. Sivilotti, Kingston, Canada

[73] Assignee: Alcan International Limited, Canada

[21] Appl. No.: 111,388

[22] Filed: Aug. 25, 1993

[51] Int. Cl.[6] ..... C25C 3/04

[52] U.S. Cl. ..... 204/70; 204/245; 204/247

[58] Field of Search ..... 204/70, 245, 247

[56] References Cited

U.S. PATENT DOCUMENTS

| | | | |
|---|---|---|---|
| 2,381,994 | 8/1945 | Belchetz | 423/158 |
| 2,381,995 | 8/1945 | Belchetz | 423/498 |
| 3,092,450 | 6/1963 | Christensen et al. | 423/498 |
| 3,317,414 | 5/1967 | Fougner | 423/498 |
| 3,341,282 | 9/1967 | Kimberlin, Jr. et al. | 423/162 |
| 3,347,626 | 10/1967 | Nightingale, Jr. | 423/498 |
| 3,352,634 | 11/1967 | Buchmann | 423/498 |
| 3,357,800 | 12/1967 | Gaska | 23/297 |
| 3,387,920 | 6/1968 | Nightingale, Jr. | 423/498 |
| 3,647,367 | 3/1972 | Macey | 423/470 |
| 3,661,738 | 5/1972 | Wheeler et al. | 204/70 |
| 3,773,471 | 11/1973 | Macey | 422/202 |
| 3,966,888 | 6/1976 | Braithwaite et al. | 423/498 |
| 3,983,224 | 9/1976 | Allain | 423/498 |
| 4,056,599 | 11/1977 | Fox III et al. | 423/178 |
| 4,076,602 | 2/1978 | Wheeler | 204/70 |
| 4,228,144 | 10/1980 | Kono et al. | 423/498 |
| 4,248,838 | 2/1981 | Allain et al. | 423/498 |
| 4,420,381 | 12/1983 | Sivilotti et al. | 204/70 |
| 4,514,269 | 4/1985 | Sivilotti | 204/69 |
| 4,560,449 | 12/1985 | Sivilotti | 204/70 |
| 4,613,414 | 9/1986 | Sivilotti et al. | 204/70 |
| 4,944,859 | 7/1990 | Matsunami et al. | 204/244 |

FOREIGN PATENT DOCUMENTS

| | | | |
|---|---|---|---|
| 61-247616 | 11/1986 | Japan . | |
| 63-162527 | 7/1988 | Japan | 23/304 |

OTHER PUBLICATIONS

U.S. patent application Ser. No. 08/043,184, filed Apr. 6, 1993, Sivilottiet al. (pending—copy not supplied).

*Primary Examiner*—Kathryn Gorgos
*Assistant Examiner*—Brendan Mee
*Attorney, Agent, or Firm*—Cooper & Dunham

[57] ABSTRACT

A process for electrolytically producing magnesium metal from $MgCl_2$ dissolved in an electrolyte, by conversion to the product metal and chlorine gas, wherein the $MgCl_2$ content of the electrolyte is replenished by supplying thereto a feed having as components one or more magnesium chloride ammoniates for decomposition by the heat of the electrolyte into $MgCl_2$ and ammonia gas. The feed, which may also include uncombined $MgCl_2$, is delivered to the electrolyte at a location at which the generated ammonia does not come into reactive contact with the chlorine gas. The temperature of the electrolyte as well as its $MgCl_2$ content can be controlled by selection of feed components, relative proportions, and rate of supply. The ammoniate content of the feed can be produced by reaction of ammonia with magnesium chloride hydrates, using the ammonia gas generated by the decomposition.

11 Claims, 2 Drawing Sheets

ELECTROLYTIC PRODUCTION OF MAGNESIUM METAL WITH FEED CONTAINING MAGNESIUM CHLORIDE AMMONIATES

BACKGROUND OF THE INVENTION

This invention relates to processes and apparatus for producing magnesium metal by electrolysis from magnesium chloride fed to an electrolytic cell for decomposition into the product metal and chlorine gas. In particular, the invention is directed to new and improved processes and apparatus of this type, wherein magnesium chloride is supplied to the cell as a feed comprising or including one or more magnesium chloride ammoniates.

Electrolytic cells for producing magnesium metal from $MgCl_2$ are well known and widely employed in present-day commercial practice. Typically, in such a cell, the $MgCl_2$ is dissolved in a molten salt electrolyte comprising a mixture of alkali metal and alkaline earth metal chlorides, in which some fluorides also may be present. Magnesium metal deposits in molten state on the cell cathode(s) and chlorine gas is generated at the anode(s) within a cell chamber; since both the metal and the gas are lighter than the electrolyte, both migrate upwardly. The magnesium metal is transported to a locality outside the cell chamber for collection and periodic removal, while the chlorine gas is separately collected and withdrawn above the cell chamber. Suitable means for controlling the cell temperature and/or electrolyte level may also be incorporated in the cell structure; one temperature control arrangement is described in U.S. Pat. No. 4,420,381.

It is conventional to provide a path for circulation of the electrolyte into the cell chamber, upwardly through the generally vertical space(s) between the facing anode and cathode surfaces (each such space being herein termed the anode-cathode distance, or "ACD"), out of the cell chamber to the metal-collecting locality, and back into the cell chamber again, provision also being made for feed of fresh quantities of $MgCl_2$ to the electrolyte before its return to the latter chamber. Such circulation of electrolyte may be effected by a pump, but it is convenient to take advantage of the gas-lift effect of the plume(s) of generated chlorine bubbles rising from the anode(s) to provide the motive power for electrolyte circulation.

For this reason, and also for the sake of economy in electrical power consumption, it is desirable that the width of each ACD (i.e., the horizontal spacing between the facing active anode and cathode surfaces of each electrode pair) be as small as possible. At the same time, to achieve reasonably high current efficiency, recombination of the produced magnesium with the liberated chlorine gas in the cell must be minimized. Among the cells affording these desired features of arrangement and operation are the so-called multipolar cells described, for example, in U.S. Pat. Nos. 4,514,269, 4,518,475, 4,560,449, 4,604,177 and 4,613,414, the disclosures of which are incorporated herein by this reference. Multipolar cells as described in the cited patents are characterized by a multiplicity of closely spaced electrodes, with interelectrode spacings (ACD widths) typically between 4 and 25 mm, more usually 4 to 15 mm. The present invention will be described herein, for purposes of illustration, as employed with cells of this type, although in its broader aspects the invention is not limited thereto.

Magnesium cells are limited in productivity by the Joule effect of the DC current employed for electrolysis. Modern cells of multipolar design operate at 2–5 kWh/kg Mg Joule effect compared to 7–13 kWh/kg Mg for older designs at similar current densities. While higher current densities would be uneconomical for older cell designs, because the unit power consumption is too high, multipolar cells could be operated economically at higher current densities (with enhanced productivity) but for the fact that heat dissipation capability sets maximum production limits for a given cell size. For good current efficiency, cell temperature must be kept within a narrow range, e.g. within $\pm 2°$ C. of an optimum value, except during metal tapping; since the heat generated in a given cell increases with increasing current density, the cell temperature will rise beyond the optimum range if the current density exceeds the limit imposed by the ability of the cell to maintain thermal balance by dissipating the generated heat.

One type of cell uses a hydrated magnesium chloride feed and its heat balance is designed accordingly. However, the hydrated feed results in rapid graphite (anode) consumption and sludge generation. These two undesirable side effects become intolerable in the operation of modern multipolar cells owing to the very small ACD in such cells; as the anode is consumed, the voltage rises and the heat generation eventually exceeds that which can be controlled by present-day thermostatic means. The natural wear of the anodes and the bipolar electrodes is the main cause of cell shutdown, when the limit imposed by thermal balance controls is reached.

A high-purity feed of anhydrous $MgCl_2$ is commonly used for multipolar cells as well as for other types of magnesium-producing electrolytic cells. Since magnesium chloride occurs in natural and artificial brines, and in ores such as carnallite and bischofite, in a polyhydrated form, e.g. as hexahydrate, it is necessary to remove the water of hydration in order to obtain the desired anhydrous feed. Ammoniated magnesium chloride compounds are usable as material for producing anhydrous magnesium chloride, and a variety of techniques have heretofore been used or proposed for treating magnesium chloride hydrates to obtain such ammoniated compounds (usually the hexammoniate, $MgCl_2.6NH_3$), as described, for example, in U.S. Pat. Nos. 2,381,994, 3,092,450, 3,352,634, 3,966,888, and 4,228,144. One such process, affording particular advantages, is described in copending U.S. patent application Ser. No. 08/043,184, filed by applicant herein jointly with J. V. Sang and R. J. R. Lemay on Apr. 6, 1993, and assigned to the same assignee as the present application. The ammoniation processes, however, involve a final step of calcining the magnesium chloride ammoniate or ammoniates to achieve anhydrous $MgCl_2$ for feed to an electrolytic cell; the calcination is expensive because it requires the supply of large amounts of heat to release the ammonia in gaseous form.

SUMMARY OF THE INVENTION

The present invention in a first aspect broadly contemplates the provision of a process for producing magnesium metal from magnesium chloride including the steps of subjecting a molten salt electrolyte containing dissolved $MgCl_2$ to electrolysis in a cell chamber for converting the $MgCl_2$ into molten magnesium metal and chlorine gas (with heating of the electrolyte), recovering the molten metal, and separately collecting the chlorine gas, wherein the improvement comprises supplying to the heated electrolyte a feed comprising at least one magnesium chloride ammoniate for decomposition (dissociation) into $MgCl_2$ and ammonia gas by heat of the electrolyte at a locality at which the ammonia gas does not come into reactive contact with the chlorine gas, thereby to abstract heat from the electrolyte while replenishing its $MgCl_2$ content as electrolysis proceeds.

As a particular feature of the invention, the supplying step may comprise producing the ammoniate by reaction of magnesium chloride values with ammonia at a second locality (preferably in accordance with the procedure disclosed in the aforementioned copending application), delivering the ammoniate to the first-mentioned locality from the second locality, and recycling the ammonia gas from the first-mentioned locality to the second locality for reaction with the magnesium chloride values to produce additional ammoniate.

Further in accordance with the invention, the feed may consist essentially of the aforesaid one ammoniate alone or in mixture with one or more materials of the group consisting of other magnesium chloride ammoniates and $MgCl_2$, and the composition and rate of supply of the feed are selected to maintain the $MgCl_2$ content of the electrolyte and the temperature of the electrolyte in the cell within predetermined ranges.

The process of the invention is especially advantageous for, and is preferably practiced with, multipolar cells as defined above. The feed comprising or containing magnesium chloride ammoniate may be forced into the electrolyte of the cell as by a screw feeder, being delivered at a location below the body of molten product magnesium metal floating on the electrolyte in a metal-collecting region of the cell, or may be dropped in particulate form on a surface of the electrolyte in a side well in which the electrolyte is in thermoconvective communication with the main body of electrolyte in the cell proper. It is important that the locality of introduction of the ammoniated material to the hot electrolyte be isolated from the chlorine gas generated in the cell, to avoid violent ammonia-chlorine reaction.

In this process, stated with particular reference to multipolar cells, the feeding of ammoniate or ammoniates is used to control the heat balance of the cell so that the cell operates at its optimum temperature, reducing or eliminating the need for other thermostatic means as were heretofore usually necessary to obtain such control, and also enabling an increase in amperage (and therefore in productivity) of the cell. The ammoniate material of the feed acts as a thermal load for the cell, absorbing heat from the electrolyte incident to the release of the combined ammonia and thereby shifting the thermal balance of the cell to a higher Joule effect point so that a higher current density can be employed (with maintenance of cell temperature within an optimum operating range) to achieve an increase in productivity.

Since different magnesium chloride ammoniates (viz., ammoniates having different degrees of ammoniation, such as hexammoniate, tetrammoniate, diammoniate, and monoammoniate) take up different amounts of heat when the combined ammonia is driven off, the temperature control of the cell as well as the $MgCl_2$ content of the electrolyte can be adjusted or optimized by selecting the rate of supply of the feed, and by providing, in the feed, two or more of the ammoniates or one or more ammoniates together with anhydrous $MgCl_2$, in appropriate relative proportions to achieve a desired thermal load. That is to say, the selection of feed constituents and the ratio of ammoniates to each other and/or to $MgCl_2$ in the feed are chosen to maintain cell operating temperature within an optimum range. These variables can be tailored to individual multipolar cells, operated at a common line amperage, that may differ from each other in thermal operating characteristics, enabling effective thermostatic control of the whole multipolar cell line and resulting in better efficiencies and longer cell lifetimes, without the undesirable side effects (high anode graphite consumption and sludge formation) that accompany use of a hydrated magnesium chloride feed.

At the same time, the process uses the surplus heat generated in the cell during electrolysis for removal of the combined ammonia from the feed material, thereby partially or totally eliminating the energy-consuming calcination step heretofore needed to obtain anhydrous $MgCl_2$ from ammoniates by known techniques. Even if some part of the feed is partially or fully precalcined (to provide lower ammoniates and/or uncombined $MgCl_2$ for incorporation in the feed), this use of cell heat to release ammonia affords substantial energy savings.

In a second aspect, the invention contemplates the provision of apparatus for performing the process described above.

Further features and advantages of the invention will be apparent from the detailed description hereinafter set forth, together with the accompanying drawings.

DETAILED DESCRIPTION

Figure 1:
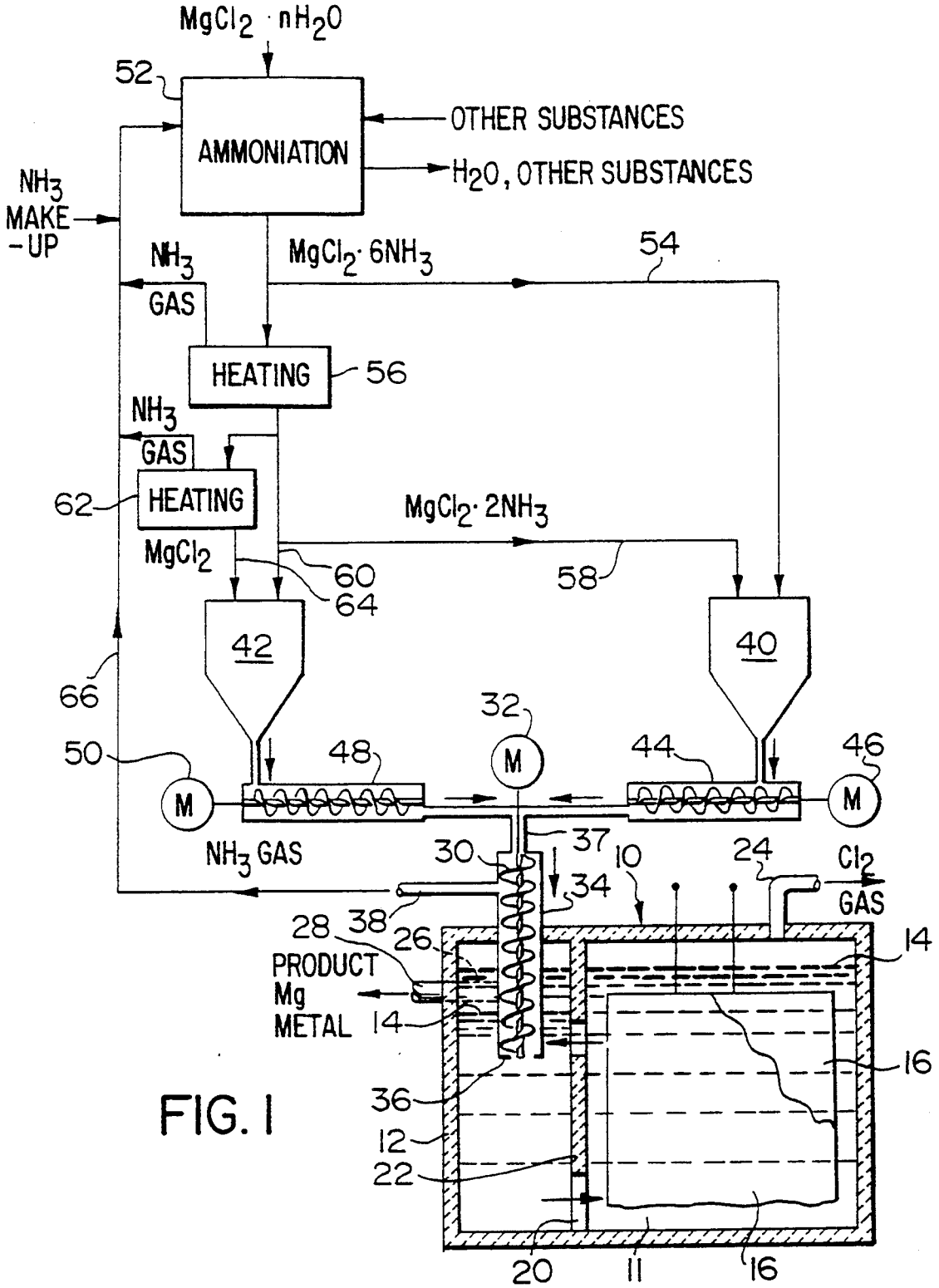
FIG. 1 is a highly simplified schematic (and partly diagrammatic) elevational view of an illustrative embodiment of the apparatus of the invention, in which the process of the invention may be practiced.

The invention will be described, with reference to the drawing, as embodied in a method and system incorporated in the operation and structure of a magnesium-producing electrolytic cell of the aforementioned multipolar type. Such a cell, designated 10 in the drawing, may (for example) be generally as shown and described in one or more of the above-cited U.S. Pat. Nos. 4,514,269, 4,518,475, 4,560,449, 4,604,177 and 4,613,414, to which reference may be made for a fully detailed explanation of cell construction and operation.

As represented in a highly simplified manner in FIG. 1, the cell 10 includes a main or cell chamber 11 and a metal collection chamber or side well 12 both substantially filled with molten salt electrolyte 14 containing dissolved $MgCl_2$. In the chamber 11 a plurality of closely spaced electrodes 16 are mounted for contact with the electrolyte, which circulates generally upwardly between the electrodes and also circulates between the chamber 11 and the side well 12 through upper and lower passages 18, 20 in a vertical dividing wall 22; as will be appreciated, the electrolyte in the side well is thus in thermoconvective communication with the electrolyte in the spaces between the electrodes 16. Passage of electric current through the electrolyte between the electrodes heats the electrolyte to an operating temperature typically at or above about 650° C., and causes molten magnesium (from the $MgCl_2$) to deposit on the cell cathodes while $Cl_2$ gas is generated at the anodes; the chlorine rises to the top of the cell chamber and is removed through means shown as a conduit 24, and the product magnesium metal, also rising, is conveyed by suitable known arrangements into the side well, where it collects as a supernatant molten body or layer 26 (i.e., as a pad of molten metal floating on the molten electrolyte in the side well 12) for periodic tapping (removal) as indicated at 28. Since the electrolytic reaction progressively consumes $MgCl_2$ of the electrolyte, the $MgCl_2$ content of the electrolyte is intermittently or continuously replenished during continuous operation of the cell.

In accordance with the present invention, such replenishment is effected by supplying to the heated electrolyte in the side well 12 a solid particulate feed comprising at least one magnesium chloride ammoniate, alone or in mixture with one or more other magnesium chloride ammoniates and/or with free $MgCl_2$. To this end, in the apparatus of FIG. 1, there is provided an axially vertical screw feeder 30 driven by means schematically shown as a motor 32 and extending downwardly into the side well 12 through the closed top of the well from a locality above the cell 10. The housing 34 of the screw feeder 30 opens, at its lower end 36, into the side well 12 at a locality substantially below the level of electrolyte 14 therein, so that electrolyte (isolated from the molten metal pad 26) rises into and fills the lower portion of the housing 34. Particulate feed is delivered to the screw feeder through a conduit 37 opening into the upper end of housing 34.

The screw feeder operates to force the particulate magnesium chloride feed downwardly into the electrolyte in the lower portion of housing 34, with mixing of the feed particles into the electrolyte. As the feed is thus introduced to the electrolyte, the magnesium chloride ammoniate content of the feed is decomposed by heat of the electrolyte into $MgCl_2$ and ammonia gas, concomitantly abstracting heat from the electrolyte as heat of decomposition of the ammoniate. The resultant $MgCl_2$ (as well as any free $MgCl_2$ initially present in the feed) dissolves in the electrolyte, as necessary to replenish the content thereof for continued magnesium production by the cell. The ammonia gas rises in the housing which is gas-tight, and is led away from the housing through a gas conduit 38. In this arrangement, the ammonia is at all times completely isolated from the chlorine gas generated in the cell 10, so as to avoid any possibility of undesired violent reaction between the ammonia and the chlorine.

Preferably, the particulate feed is advanced to the conduit (for delivery to screw feeder 30) from one or both of two bins respectively designated 40 and 42. Feed from bin 40 is conveyed to the conduit 37 by a screw feeder 44 driven by a motor 46 while feed from bin 42 is conveyed to the conduit 37 by a further screw feeder 48 separately driven by a motor 50. The motors 46 and 50 are individually operable, for example by a generally conventional cell temperature programmable controller (not shown), as hereinafter further explained, to vary the relative rates of supply of feed from the two bins to the conduit 37 and thereby to vary the relative proportions of feed from the two bins delivered to the screw feeder 30 for introduction to the cell electrolyte 14.

The provision of magnesium chloride ammoniate as or in the feed to the cell electrolyte serves two important purposes. First, it affords energy savings in the production of an anhydrous $MgCl_2$ cell feed by ammoniation (e.g. of magnesium chloride initially in naturally-occurring or other hydrated form), since heat generated in the cell itself is utilized as at least part of the thermal energy required to decompose the ammoniate, whereas prior ammoniation processes ordinarily employed a separate heat supply to calcine the ammoniate. Second, the decomposition reaction, by taking up heat from the cell electrolyte, enables maintenance of the cell at a desired substantially constant temperature even at current densities which are advantageously higher than those that can be used in conventional cell operation.

The two-bin feed system described above contributes, in particular, to the beneficial control of cell temperature. Different magnesium chloride ammoniates (monoammoniate, diammoniate, hexammoniate, etc. ) differ from each other in the amount of heat (per unit weight of ammoniate) taken up in decomposing them. Thus, with different mixtures of ammoniates in the two bins, e.g., a mixture of hexammoniate and diammoniate in bin 40 and a mixture of diammoniate and free $MgCl_2$ in bin 42, and with adjustment of the relative proportions of material from the respective bins delivered to the screw feeder 30 for supply to the cell electrolyte, the ammoniate feed to the cell can be tailored to provide the particular thermal load, and resultant heat absorption, required to maintain a desired temperature in a given cell.

The differences between the heats of formation of solid $MgCl_2$ plus gaseous $NH_3$ and the heats of formation of the ammoniates are as follows:

| Compound | $\Delta H$ (298° C.) (KJ/mol) | Difference (KJ/mol $MgCl_2$) | Difference (kWh/kg Mg) |
|---|---|---|---|
| $MgCl_2.6NH_3$ | −1075 | 159 | 1.82 |
| $MgCl_2.4NH_3$ | −931 | 106 | 1.21 |
| $MgCl_2.2NH_3$ | −788 | 55 | 0.63 |
| $MgCl_2.NH_3$ | −714 | 27 | 0.31 |
| anhydrous $MgCl_2$ (solid) | −641 | — | — |
| $NH_3$ (gas) | −46 | — | — |

It will be appreciated that the "difference" in KJ/mol $MgCl_2$ in the above table is the difference between the separate heats of formation of $MgCl_2$ + n times $NH_3$ and the heat of formation of $MgCl_2$ $nNH_3$. For example, the separate heats of formation of $MgCl_2$ and 4 times $NH_3$ are $(-641)+4\times(-46)=-825$ KJ/mol $MgCl_2$ while the heat of formation of $MgCl_2$ $4NH_3$ is −931 KJ/mol $MgCl_2$, giving a difference of 106 KJ/mol $MgCl_2$.

As stated above, present-day multipolar cells conventionally operate at 2–5 kWh/kg Mg Joule effect, being limited in current density (and,consequently in productivity) by the requirement for constant-temperature operation and the limited ability of conventional cell designs to dissipate heat generated in the cell. The present invention enables an increase in the productivity of a cell of a given design by shifting the thermal balance to a higher Joule effect point. Depending on the degree of ammoniation, 1 to 6, the additional Joule effect required to compensate for the differences in heats of formation (0 to 1.8 kWh/kg Mg as set forth in the above table), plus the heat required to heat up the ammonia to dissociation temperatures, allows an increase in current density and productivity up to 20% of conventional nominal density and productivity.

Typically, a plurality of cells are connected in a line, and the individual cells differ from each other in operating characteristics so as to require different thermal loads for heat balance. The present invention enables individual control of the degree of ammoniation of the magnesium chloride fed to each of a line of cells in relation to the equilibrium heat balance of the cell operated at line amperage (for example, by feeding magnesium chloride with a higher degree of ammoniation to the cells that tend to run above target temperature, and vice versa for cells that tend to run below), so as to achieve thermostatic control of the whole cell line, resulting in better efficiencies and longer cell lives, and without undesirable side effects such as high graphite consumption and sludge formation that would occur if hydrated chloride feeds were used.

Stated in other words, the variation of the degree of ammoniation of the feed supplied to a cell in accordance with the present invention can be obtained, for example, by metering into a feeding apparatus a controlled mass flow ratio of material from the two feed storage bins 40 and 42, one being loaded with, for example, magnesium chloride hexammoniate and diammoniate for hot running cells and the other being loaded with magnesium chloride diammoniate and anhydrous $MgCl_2$ for cold running cells. The mixed material is metered into the cell electrolyte at a rate such as to maintain the electrolyte within its optimum composition limits and in response to a cell temperature programmable controller of generally conventional design. As will be understood, the content of each of the bins 40 and 42 is a mixture of .predetermined ingredients (ammoniates and/or $MgCl_2$) in predetermined constant proportions; the programmable controller senses cell temperature and controls the operation of the motors 46 and 50 in accordance therewith to provide the appropriate mass flow ratio of material from the two bins into the screw feeder 30 for heat absorption to achieve and maintain a substantially constant predetermined cell temperature.

A simplified flow diagram of a convenient and currently preferred process and system for producing and supplying the ammoniates and $MgCl_2$ delivered to the bins 40, 42 is included in FIG. 1. This process is of the type described in the aforementioned copending application Ser. No. 08/043,184 for obtaining anhydrous $MgCl_2$ from a raw material containing hydrated magnesium chloride. As there set forth, for that purpose, the process broadly includes the steps of establishing a solution of hydrated magnesium chloride; reacting this solution at substantially ambient temperature and pressure by feeding it into an ammonia-saturated very low boiling point alcohol solution and in the presence of ammonium chloride, while maintaining the last-mentioned solution saturated with ammonia, thereby to form a precipitate of magnesium chloride hexammoniate; separating the precipitate of hexammoniate from the last-mentioned solution; and decomposing the separated precipitate into anhydrous $MgCl_2$ and ammonia.

Natural or artificial $MgCl_2$ brines, bischofite ($MgCl_2.6H_2O$), carnallite ($KCl.MgCl_2.6H_2O$) or ammonium carnallite ($NH_4Cl.MgCl_2.6H_2O$) or any other magnesium chloride containing material may be used as raw materials for the process of the copending application, or, in order to minimize the input of water to the process, the starting material (brine, bischofite or carnallite) may be pretreated to remove some of the water from the magnesium chloride polyhydrate by known thermal processes, and the resultant magnesium chloride n.hydrate ($n<6$) may be used as feed to the process.

Specifically, in an illustrative embodiment of the process of the copending application, magnesium chloride brine from a brine tank and recycled $NH_4Cl$ solution are first partially dehydrated in a spray dryer to a moisture content e.g. corresponding to the dihydrate, $MgCl_2.2H_2O$. The spray dried product is then dissolved in methanol in a dissolver. The resulting alcoholate solution is fed to a crystallizer in which a high saturation of ammonia is continuously maintained with the aid of a blower. This crystallizer is designed to provide high agitation able to disperse the incoming alcoholate solution rapidly into the ammoniate solution to avoid any local undersaturation with respect to ammonia which would result in $Mg(OH)_2$ formation. As mentioned also in U.S. Pat. No. 4,228,144, it is preferable to disperse the feed solution uniformly in fine droplets into the reacting solution by the use of feeding nozzles.

After centrifuging and washing, the ammoniate compound formed is dried in a dryer and decomposed in a calciner into product anhydrous $MgCl_2$ and $NH_3$ gas for recycling. The remaining alcoholate solution contains methanol, ammonium salt, ammonia and water but only small amounts of unreacted magnesium chloride. The methanol and the ammonia are separated from the water and ammonium salt in a multipurpose distillation unit and recycled to the process.

In the described embodiment of the process of the copending application, the feed of hydrated magnesium chloride may be accompanied by impurities insoluble in methanol. As stated above, this feed is combined, in the aforementioned spray dryer, with a liquid recycle stream containing ammonium chloride together with water and some magnesium chloride values. The water is driven off in the spray dryer, and the resultant dried magnesium chloride dihydrate (together with its accompanying impurities) and the ammonium chloride are delivered from the dryer to methanol in the dissolver, thereby to form a solution of magnesium chloride dihydrate and ammonium chloride in the dissolver. The impurities insoluble in methanol are separated and removed from this solution, i.e., from the discharge from the dissolver.

The impurity-free solution is delivered from the dissolver to the crystallizer, which in steady-state operation is filled with the reacting solution, and to which (as also stated above) gaseous ammonia is continuously supplied by the blower to maintain the solution saturated with ammonia. Magnesium chloride hexammoniate precipitates from the solution in the crystallizer. The water of hydration is, of course, also present in the solution, but its reaction with magnesium values to form magnesium hydroxide is suppressed by the presence of the ammonium chloride.

From the bottom of the crystallizer, the magnesium chloride hexammoniate is carried in a liquid flow of the methanol (now containing dissolved ammonia, water, and ammonium chloride) from the crystallizer to the centrifuge, where it is separated from the latter flow as a cake and washed with ammonia-saturated methanol. The cake wash (mainly ammonia-saturated methanol) is recycled to the crystallizer, while the aforementioned liquid flow of methanol (also containing most of the water, the ammonium chloride and small magnesium chloride values) passes from the centrifuge to the stripper. The washed hexammoniate cake is delivered to a dryer in which all of the residual methanol and part of the ammonia are removed with heat, and thence (e.g. as diammoniate) passes to the calciner for thermal decomposition into anhydrous magnesium chloride product and ammonia gas.

In the last-mentioned dryer and the calciner some methanol and mainly ammonia gas are evolved. This gas is delivered to the stripper, which separates the liquid and gas supplied thereto into a gaseous ammonia stream, which is recycled to the blower (along with excess ammonia from the top of the crystallizer); a liquid, ammonia-saturated methanol stream, which is recycled to the centrifuge to provide cake wash solution; a liquid methanol stream, which is recycled to the dissolver; and a liquid magnesium chloride —ammonium chloride—water stream, which is recycled to the spray dryer for mixture with fresh hydrated magnesium chloride feed from the brine tank. The water of hydration from the hydrated feed (retained in the process stream upon ammoniation of the magnesium chloride in the crystallizer) is thus ultimately driven off from the spray dryer, while the ammonia, ammonium chloride and methanol are continuously recycled and reused.

In this process, operating in a continuous manner, the feed solution of magnesium chloride dihydrate and ammonium chloride in methanol from the dissolver is, in effect, introduced in the crystallizer to an ammonia-saturated methanol solution (containing ammonium chloride continuously supplied) for ammoniation therein, the latter solution being replenished not only by fresh inflow of feed solution but also by recycled cake wash solution from the centrifuge. The ammoniation in the crystallizer is performed at substantially ambient temperature and pressure, a preferred temperature range being about 10°–40° C.

As adapted for the practice of the present invention, and as shown in FIG. 1, the foregoing process includes the production of a precipitate of magnesium chloride hexammoniate from a starting magnesium chloride hydrate, such production being represented by ammoniation step 52. The starting hydrate is supplied to this step together with ammonia gas and other substances (a very low boiling point alcohol such as methanol and $NH_4Cl$), and water and other substances are separated out for removal or recycling, all as described above.

A portion of the hexammoniate precipitate in particulate solid form (i.e. with volatiles driven off, by a suitable heating operation omitted from the drawing for simplicity, but without dissociation of any ammonia) is delivered as $MgCl_2.6NH_3$ directly to the bin 40, as indicated by line 54, while the remainder of the produced hexammoniate is subjected to a heating step 56 to convert it to the diammoniate, $MgCl_2.2NH_3$, with evolution of ammonia gas. Portions of the diammoniate, again in particulate solid form, are delivered to both bins 40 and 42 (lines 58 and 60) and the remainder is subjected to a further heating step 62 in which all ammonia is driven off, leaving particulate anhydrous $MgCl_2$, which is delivered to bin 42 as indicated by line 64.

Thus, bin 40 is supplied with a mixture of magnesium chloride hexammoniate and diammoniate while bin 42 is supplied with a mixture of diammoniate and $MgCl_2$. The feed of materials to the two bins is controlled (by suitable means, not shown) to maintain constant predetermined relative proportions of the specified feed components in each. Owing to the differences in heats of formation noted above, a given quantity of the material from bin 40 will absorb more heat from the cell electrolyte 14 when supplied thereto and decomposed than will the same quantity of material from bin 42, and the amount of heat absorbed from the cell per unit quantity of delivered feed can be varied, between these upper and lower limits, by appropriate mixtures of material from the two bins.

Much of the heat required to decompose or dissociate the ammoniates is provided by the cell 10, so that there is a significant economy in energy consumption as compared to ammoniation processes in which all the heat required to decompose the ammoniate to product anhydrous $MgCl_2$ must be externally supplied. This saving is realized even though some heat must be supplied externally (to heating steps 56 and 62) in order to provide the range of materials of different degrees of ammoniation needed to make up the different mixtures in bins 40 and 42.

The ammonia evolved in the screw feeder housing 34, and carried therefrom in conduit 38, is advantageously recycled (line 66) to the ammoniation step 52 for use in producing fresh quantities of magnesium chloride hexammoniate. The ammonia gas generated in heating steps 56 and 62 is similarly recycled to step 52, to which make-up ammonia gas is also supplied as needed.

Figure 2:
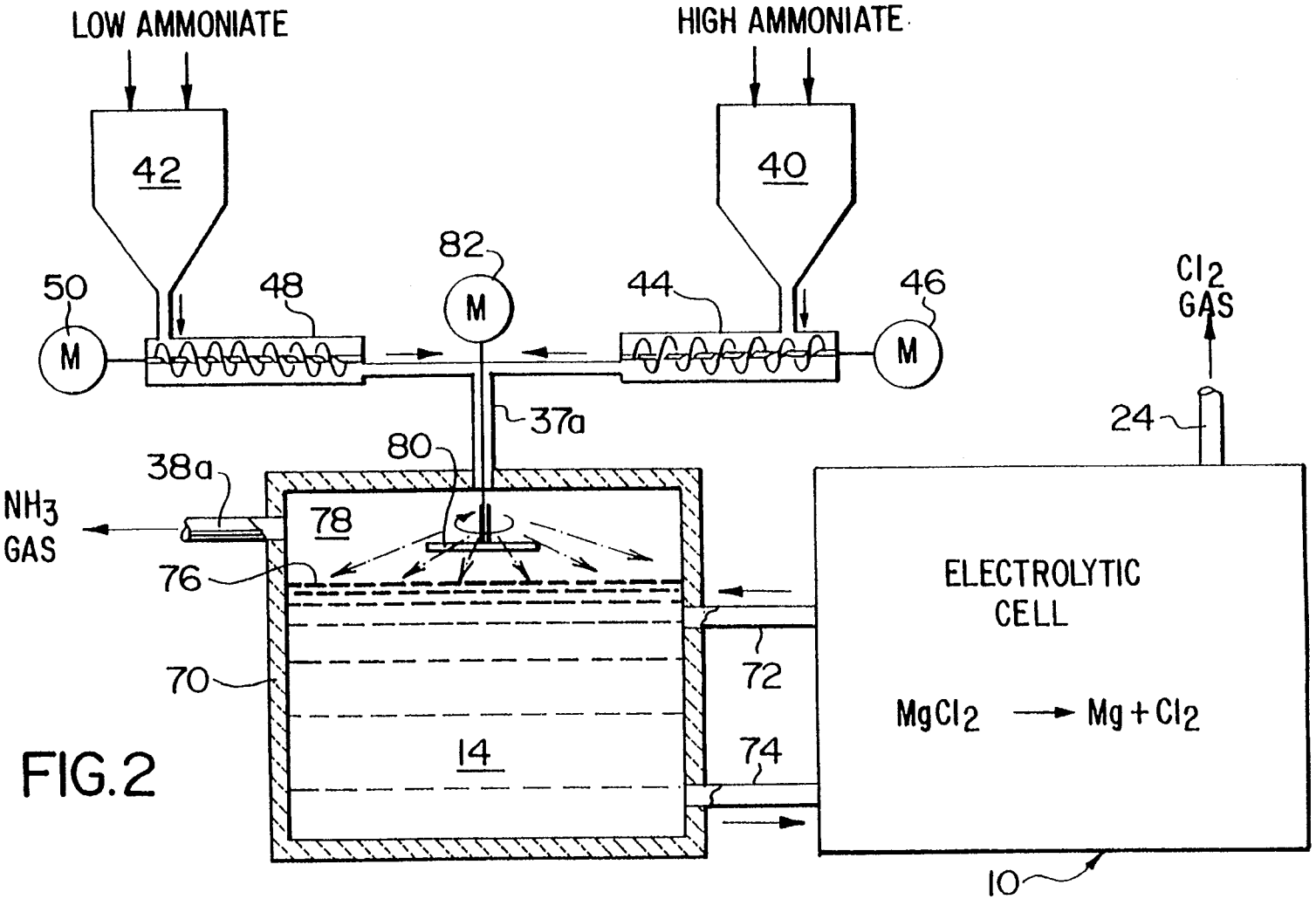
FIG. 2 is a similar view of a modified embodiment of such apparatus for the practice of the present process.

FIG. 2 illustrates a modified apparatus and procedure for delivery of the feed comprising or including magnesium chloride ammoniate(s), with or without $MgCl_2$, to the cell 10, by a surface feeding technique. This apparatus includes a separate side well 70 through which electrolyte 14 is circulated to and from the cell 10 by conduits 72, 74, such that the electrolyte in the side well is in thermoconvective communication with the electrolyte in the main (electrode) chamber of the cell. Within the well 70 the electrolyte has an exposed upper surface 76 above which is a gas space 78 fully enclosed by the well structure.

A spinning distributor tray 80, having a vertical axis of rotation and shown as driven by a motor 82, is disposed within this gas space above the electrolyte surface 76. A vertical conduit 37*a*, corresponding to conduit 37 of FIG. 1, opens downwardly through the roof of the well 70 to deliver particulate feed material onto the spinning tray 80. The feed (which is the same as that delivered to screw feeder 30 through conduit 37 in FIG. 1) is supplied from the same arrangement of bins 40 and 42 and screw feeders 44, 48 driven by motors 46, 50 as in FIG. 1 and in the same manner, e.g. under control of a cell temperature programmable controller (not shown). That is to say, in all respects, the composition of the feed, and the function and operation of the bins and their associated screw feeders and motors to deliver an ammoniate-containing feed in appropriate relative proportions of components, together with the process for providing the feed components, may be exactly as described with reference to FIG. 1.

The feed, dropped by gravity in the form of powder or pellets from the conduit 37*a* onto the spinning distributor tray 80, is strewn or scattered by the tray onto the free surface 76 of the electrolyte to form a crust thereon or to dissolve soon after contact with the open surface of the electrolyte. As in the embodiment of FIG. 1, the heat of the electrolyte (from the cell operation) decomposes the ammoniates in the feed, the generated ammonia gas being conveyed from well 70 by conduit 38*a* for recycling (as by line 66 shown in FIG. 1) to the ammoniation step 52 of FIG. 1. Also as in the FIG. I embodiment, the absorption of heat incident to decomposition of the ammoniate(s) provides a thermal load for control of cell temperature. That is to say, owing to the thermoconvective communication between the electrolyte in the side well 70 and the main body of the electrolyte in the cell 10, the thermal and mass balance can be maintained by natural thermoconvective flows.

The side well (like the screw feeder 30 of FIG. 1) needs to be well separated from the electrolysis compartment and chlorine collection system of the cell, to prevent the reaction (violent) between ammonia and chlorine. Also, the surface of the side well needs to be at least periodically inspected and cleaned from buildup of permanent crusts and/or of magnesium metal, so that the rate of dissolution of the feed material into the electrolyte is not impeded.

It is to be understood that the invention is not limited to the procedures and embodiments hereinabove specifically set forth, but may be carried out in other ways without departure from its spirit.

What is claimed is:

1. A process for producing magnesium metal from magnesium chloride including the steps of (a) subjecting a molten salt electrolyte containing dissolved $MgCl_2$ to electrolysis in a cell chamber for converting the $MgCl_2$ into molten magnesium metal and chlorine gas, with heating of the electrolyte, (b) recovering the molten metal, and (c) separately collecting the chlorine gas, wherein the improvement comprises:

(d) supplying to the heated electrolyte a feed comprising at least one magnesium chloride ammoniate for decomposition into $MgCl_2$ and ammonia gas by heat of the electrolyte at a locality at which the ammonia gas does not come into reactive contact with the chlorine gas, thereby to abstract heat from the electrolyte while replenishing its $MgCl_2$ content as electrolysis proceeds.

2. A process according to claim 1, wherein the supplying step comprises producing said one ammoniate by reaction of magnesium chloride values with ammonia at a second locality, delivering said one ammoniate to the first-mentioned locality from said second locality, and recycling said ammonia gas from the first-mentioned locality to said second locality for reaction with said magnesium chloride values as aforesaid.

3. A process according to claim 1, wherein said feed consists essentially of said one ammoniate alone or in mixture with one or more materials of the group consisting of other magnesium chloride ammoniates and $MgCl_2$, and wherein the composition and rate of supply of said feed are selected to maintain the $MgCl_2$ content of the electrolyte and the temperature of the electrolyte in the cell within predetermined ranges.

4. A process according to claim 3, wherein said feed comprises at least two magnesium chloride ammoniates differing from each other in degree of ammoniation.

5. A process according to claim 3, wherein said feed comprises at least one magnesium chloride ammoniate and anhydrous $MgCl_2$.

6. A process according to claim 1, wherein step (a) is performed in a multipolar cell.

7. A process according to claim 6, wherein step (d) is performed by delivering the feed to the electrolyte at a location below a body of molten product magnesium metal floating on the electrolyte in a metal-collecting region of the cell.

8. A process according to claim 6, wherein step (d) is performed by dropping the feed in particulate form on a surface of the electrolyte in a side well in which the electrolyte is in thermoconvective communication with electrolyte in the cell chamber.

9. Apparatus for producing magnesium metal from magnesium chloride, including:

(a) a multipolar cell, having a chamber and a plurality of electrodes therein, for subjecting a molten salt electrolyte containing dissolved $MgCl_2$ to electrolysis in said chamber for converting the $MgCl_2$ into molten magnesium metal and chlorine gas, with passage of the electrolyte through at least one space defined between the electrodes and with heating of the electrolyte;

(b) means for recovering the molten metal from the cell; and (c) means for separately collecting the chlorine gas from the cell;

(d) means, including an enclosed region for containing heated electrolyte in thermoconvective communication with electrolyte passing through said one space, for supplying to the heated electrolyte a feed comprising at least one magnesium chloride ammoniate for decomposition into $MgCl_2$ and ammonia gas by heat of the electrolyte while maintaining the ammonia gas isolated from reactive contact with the chlorine gas, thereby to abstract heat from the electrolyte while replenishing its $MgCl_2$ content as electrolysis proceeds; and (e) means for conducting the ammonia gas from said region out of contact with the chlorine gas;

(f) said region being a region in which produced molten magnesium metal collects as a layer floating on the electrolyte; and wherein said supplying means further comprises a conveyor for delivering said feed downwardly through but isolated from contact with said layer and into the electrolyte in said region below said layer.

10. Apparatus for producing magnesium metal from magnesium chloride, including:

(a) a multipolar cell, having a chamber and a plurality of electrodes therein, for subjecting a molten salt electrolyte containing dissolved $MgCl_2$ to electrolysis in said chamber for converting the $MgCl_2$ into molten magnesium metal and chlorine gas, with passage of the electrolyte through at least one space defined between the electrodes and with heating of the electrolyte;

(b) means for recovering the molten metal from the cell; and (c) means for separately collecting the chlorine gas from the cell;

(d) means, including an enclosed region for containing heated electrolyte in thermoconvective communication with electrolyte passing through said one space, for supplying to the heated electrolyte a feed comprising at least one magnesium chloride ammoniate for decomposition into $MgCl_2$ and ammonia gas by heat of the electrolyte while maintaining the ammonia gas isolated from reactive contact with the chlorine gas, thereby to abstract heat from the electrolyte while replenishing its $MgCl_2$ content as electrolysis proceeds; and (e) means for conducting the ammonia gas from said region out of contact with the chlorine gas;

(f) the supplying means comprising means for holding a first feed component comprising at least said one ammoniate, means for holding a second feed component comprising material selected from the group consisting of at least one ammoniate and anhydrous $MgCl_2$ and mixtures thereof, the materials of said first and second components having respectively different thermal absorption capacities, and means for delivering said first and second components from the respective holding means to said region at individually controllable rates for supplying to the electrolyte in said region a feed comprising a mixture of said first and second components in relative proportions for imparting to the delivered feed a selected thermal absorption capacity.

11. Apparatus as defined in claim 10, wherein said delivering means comprises a first driven conveyor for delivering said first component and a second, separately driven conveyor for delivering said second component.

* * * * *